US006361149B1

(12) United States Patent
Abe

(10) Patent No.: US 6,361,149 B1
(45) Date of Patent: Mar. 26, 2002

(54) INK JET HEAD CONFIGURED TO INCREASE PACKAGING DENSITY OF COUNTER ELECTRODE AND OSCILLATION PLATE

(75) Inventor: Shuya Abe, Hyogo (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 09/458,355

(22) Filed: Dec. 9, 1999

(30) Foreign Application Priority Data

Dec. 10, 1998 (JP) ..... 10-350609

(51) Int. Cl.[7] ..... B41I 2/06
(52) U.S. Cl. ..... 347/55
(58) Field of Search ..... 347/55, 54, 20, 347/50, 47

(56) References Cited

U.S. PATENT DOCUMENTS

| | | | | | |
|---|---|---|---|---|---|
| 5,652,609 | A | * | 7/1997 | Scholler et al. | 347/54 |
| 5,670,999 | A | * | 9/1997 | Takeuchi et al. | 347/70 |
| 5,886,713 | A | * | 3/1999 | Okada et al. | 347/14 |
| 6,117,698 | A | * | 9/2000 | Atobe et al. | 438/21 |
| 6,137,511 | A | * | 10/2000 | Furuhata et al. | 347/70 |
| 6,198,263 | B1 | * | 1/2001 | Nojima et al. | 347/54 |
| 6,193,360 | B1 | * | 2/2001 | Nishiwaki et al. | 347/70 |

FOREIGN PATENT DOCUMENTS

| | | | |
|---|---|---|---|
| JP | 5-169660 | 7/1993 | B41J/2/05 |
| JP | 7-125196 | 5/1995 | B41J/2/045 |
| JP | 9-148062 | 6/1997 | B41J/2/04 |

* cited by examiner

*Primary Examiner*—N. Le
*Assistant Examiner*—K. Feggins
(74) *Attorney, Agent, or Firm*—Greenberg Traurig, LLP

(57) ABSTRACT

An ink jet head includes a nozzle plate which has a nozzle hole. An ink-chamber substrate is provided on a back of the nozzle plate and includes an integrally-formed oscillation plate and a pressure chamber. The pressure chamber contains ink and is arranged to communicate with the nozzle hole. The oscillation plate defines a bottom of the pressure chamber. A counter-electrode substrate has an electrically-isolated counter electrode. The counter electrode is arranged to face the oscillation plate via a gap between the oscillation plate and the counter electrode. A dielectric layer is interposed between the ink-chamber substrate and the counter-electrode substrate. The dielectric layer is arranged to define the gap between the oscillation plate and the counter electrode. A pad metal piece is provided on a back of the counter electrode. The pad metal piece is electrically connected to the counter electrode and a driving voltage is externally supplied from the pad metal piece to the counter electrode so that the oscillation plate is actuated to impart a force to and stress the ink within the pressure chamber.

20 Claims, 6 Drawing Sheets

INK JET HEAD CONFIGURED TO INCREASE PACKAGING DENSITY OF COUNTER ELECTRODE AND OSCILLATION PLATE

BACKGROUND OF THE INVENTION

1. Field of the Invention

The present invention relates to an ink jet head which discharges ink through a nozzle hole onto a recording sheet by imparting a force to the contained ink within the ink jet head. The ink jet head of the present invention is suitably applicable to various image forming apparatuses including printers, facsimiles and copiers.

2. Description of the Related Art

Japanese Laid-Open Patent Application No. 7-125196 discloses a conventional ink jet head. FIG. 5A is a cross-sectional side view of the conventional ink jet head, and FIG. 5B is a cross-sectional view of the conventional ink jet head taken along a line B—B of FIG. 5A.

As shown in FIG. 5A and FIG. 5B, the conventional ink jet head is constructed by joining together a first substrate 1, a second substrate 2 and a third substrate 3. These substrates 1, 2 and 3 are joined together so that a nozzle hole 4, an ink chamber 6, an orifice 7 and an ink cavity 8 are provided therein.

The first substrate 1 includes the ink chamber 6 and an oscillation plate 5 integrally formed with the first substrate 1. The oscillation plate 5 is located beneath the ink chamber 6. The second substrate 2 includes an individual counter electrode 9 which is disposed on the second substrate 2 and faces the oscillation plate 5 through an internal space or gap "G" between the oscillation plate 5 of the first substrate 1 and the counter electrode 9 of the second substrate 2. A lead of the counter electrode 9 on a mounted surface "I" and a common electrode (not shown) extending from the oscillation plate 5 on a mounted surface "II" are electrically connected to a driver circuit 11. A driving voltage between the individual counter electrode 9 and the common electrode is supplied by the driver circuit 11.

Hereinafter, the first substrate 1 is referred to as the ink-chamber substrate 1, and the second substrate 2 is referred to as the counter-electrode substrate 2.

In the conventional ink jet head, when the driving voltage supply is turned on, an electrostatic force is created so as to downwardly pull the oscillation plate 5 toward the individual counter electrode 9. When the supplying of the driving voltage is turned off, the oscillation plate 5 is upwardly deflected so as to impart a force to and stress the ink within the ink chamber 6 such that the ink is discharged from the nozzle hole 4 onto a recording sheet 12.

As shown in FIG. 5A and FIG. 5B, in the structure of the above-mentioned ink jet head, the leads of the counter electrodes 9 are disposed on the mounted surface I, and the common electrode extending from the oscillation plate 5 is disposed on the mounted surface II. The mounted surface I of the leads of the counter electrodes 9 and the mounted surface II of the common electrode routed from the oscillation plate 5 have different heights. A mounting process for mounting the ink-chamber substrate 1 on the counter-electrode substrate 2, and a mounting process for mounting the third substrate 3 on the ink-chamber substrate 1 must be separately performed, and these processes are very complicated and expensive because the leads of the counter electrodes 9 and the common electrode are mounted on the mounted surfaces I and II with different heights.

Further, it is necessary to route the leads of the counter electrodes 9 to the connection points on the mounted surface "I", as well as to route the common electrodes from the oscillation plates 5 to the connection points on the mounted surface "II", in order to establish both the electrical connection between the counter electrodes 9 and the driver circuit 11 and the electrical connection between the common electrodes and the driver circuit 11. This conventional ink jet head has connection points provided on the mounted surfaces "I" and "II" with different heights, and requires the relatively-large ink-chamber substrate 1 and the relatively-large counter-electrode substrate 2. Accordingly, it is difficult for such a conventional ink jet head to achieve a high-density packaging of the counter electrodes and the oscillation plates in small-size substrates, as well as simple, inexpensive assembly processes.

Japanese Laid-Open Patent Application No. 5-169660 discloses another conventional ink jet head. FIG. 6 is a cross-sectional view of this conventional ink jet head.

As shown in FIG. 6, the conventional ink jet head includes a supporting board 21, a heater board 23 and a flexible wiring board 25. The heater board 23 is provided on the supporting board 21, and contains an energy-generating element which produces energy used to impart a force to and stress the ink within the conventional ink jet head in accordance with a print signal. When the energy is created by the energy-generating element of the heater board 23, the ink is discharged from a nozzle hole 22 onto a recording sheet.

In the conventional ink jet head of FIG. 6, the flexible wiring board 25 is provided on the supporting board 21, and the flexible wiring board 25 is electrically connected to the heater board 23 through a wire bonding or a tape automated bonding (TAB). A plurality of connection pads 24 are formed on the wiring board 25, and the wiring board 25 is connected through the connection pads 24 to a main part of a printing device. The main part of the printing device supplies the print signal to the wiring board 25 via the connection pads 24, and the wiring board 25 transfers the print signal to the heater board 23 via the bonded wire.

As shown in FIG. 6, in the structure of the above-mentioned conventional ink jet head, the flexible wiring board 25 must be bent at the end of the supporting board 21 so as to extend from the top surface of the supporting board 21 to the bottom surface thereof. The connection pads 24 are provided on the bottom surface of the wiring board 25, and the top surface of the wiring board 25 is connected to the heater board 23 by the bonded wire or the TAB.

The conventional ink jet head shown in FIG. 6 must be produced using the relatively-large supporting board 21, and the supporting board 21 must have an adequately large thickness for attaching the flexible wiring board 25 thereto. It is difficult that the conventional ink jet head of the above publication be provided with a smaller supporting board 21. Further, the conventional ink jet head of FIG. 6 requires the wire bonding or the TAB bonding, the mounting and bending of the flexible wiring board 25 and the soldering in order to provide the connection pads 24 on the bottom-side surface of the wiring board 25, and it is difficult to achieve simple, inexpensive assembly processes.

Further, Japanese Patent Application No. 9-148062, which is assigned to the owner of the present invention, discloses another conventional ink jet head. FIG. 7 is a cross-sectional view of the conventional ink jet head of the above-mentioned application.

As shown in FIG. 7, the conventional ink jet head includes a glass substrate 31 in which a via hole 32 is formed. A conductive material is plated in the via hole 32, and the via hole 32 serves as a conductive through hole in the glass substrate 31. The conventional ink jet head of FIG. 7 further includes an ink supply hole 37, an ink chamber 38, and a nozzle hole 39. An oscillation plate 33 under the ink chamber 38 is provided above the glass substrate 31, and a counter electrode 34 which faces the oscillation plate 33 through an internal space is provided in a recessed portion of the glass substrate 31.

In the conventional ink jet head of FIG. 7, a bump-plated conductor 35 is provided on the bottom of the glass substrate 31. The counter electrode 34 is electrically connected to the bump-plated conductor 35 by the via hole 32. A driving voltage between the counter electrode 34 and the oscillation plate 33 is externally supplied from the bump-plated conductor 35.

Similar to the ink jet head of FIG. 5A, in the conventional ink jet head of FIG. 7, when the driving voltage supply is turned on, an electrostatic force is created so as to downwardly pull the oscillation plate 33 toward the counter electrode 34 via the internal space. When the driving voltage supply is turned off, the oscillation plate 33 is upwardly deflected so as to impart a force to and stress the ink within the ink chamber 38, and the ink is discharged from the nozzle hole 39 onto a recording sheet.

In the structure of the conventional ink jet head of FIG. 7, it is difficult to form the via hole 32 in the glass substrate 31 with accurate dimensions because of the use of the glass substrate 31. It is also difficult to ensure an accurate depth of the gap between the counter electrode 34 and the oscillation plate 33. Accordingly, it is difficult for the conventional ink jet head of FIG. 7 to achieve a high-density packaging of the counter electrodes and the oscillation plates in small-size substrates as well as simple, inexpensive assembly processes.

SUMMARY OF THE INVENTION

In order to overcome the problems described above, preferred embodiments of the present invention provide an improved ink jet head which achieves a high-density packaging of the counter electrodes and the oscillation plates in small-size substrates as well as simple, inexpensive assembly processes.

According to one preferred embodiment of the present invention, an ink jet head discharges ink through a nozzle hole onto a recording sheet by stressing the ink within the ink jet head. The ink jet head includes a nozzle plate which has a nozzle hole, an ink-chamber substrate which is provided on a back of the nozzle plate and includes an integrally-formed oscillation plate and a pressure chamber, the pressure chamber containing ink and communicating with the nozzle hole, and the oscillation plate defining a bottom of the pressure chamber, a counter-electrode substrate which has an electrically isolated counter electrode, the counter electrode facing the oscillation plate via a gap between the oscillation plate and the counter electrode, a dielectric layer which is interposed between the ink-chamber substrate and the counter-electrode substrate, the dielectric layer being arranged to define the gap between the oscillation plate and the counter electrode, and a pad metal piece which is provided on a back of the counter electrode and is electrically connected to the counter electrode, and a driving voltage being externally supplied from the pad metal piece to the counter electrode so that the oscillation plate is actuated to stress the ink within the pressure chamber.

In another preferred embodiment of the ink jet head of the present invention, a dielectric layer preferably made of a thermal oxidation silicon dioxide is provided. The dielectric layer is interposed between the ink-chamber substrate and the counter-electrode substrate. The dielectric layer is arranged to define the gap between the oscillation plate and the counter electrode. The ink jet head having the dielectric layer arranged in this unique manner can be easily configured with low cost by using a photolithography and etching technique. Further, in this preferred embodiment of the ink jet head of the present invention, the pad metal piece is provided on the back of the counter electrode and is electrically connected to the counter electrode. Further, in this preferred embodiment of the ink jet head of the invention, the ink-chamber substrate is preferably made of a single-crystal silicon and the counter-electrode substrate is preferably made of either a single-crystal silicon or a metallic material. The ink jet head of preferred embodiments of the present invention having these elements arranged in the above manner is effective in achieving a high-density packaging of counter electrodes and oscillation plates in small-size substrates as well as simple, inexpensive assembly processes.

BRIEF DESCRIPTION OF THE DRAWINGS

Other objects, features and advantages of the present invention will become more apparent from the following detailed description when read in conjunction with the accompanying drawings in which.

DETAILED DESCRIPTION OF PREFERRED EMBODIMENTS

A description will now be provided of preferred embodiments of the present invention with reference to the accompanying drawings.

Figure 1A:
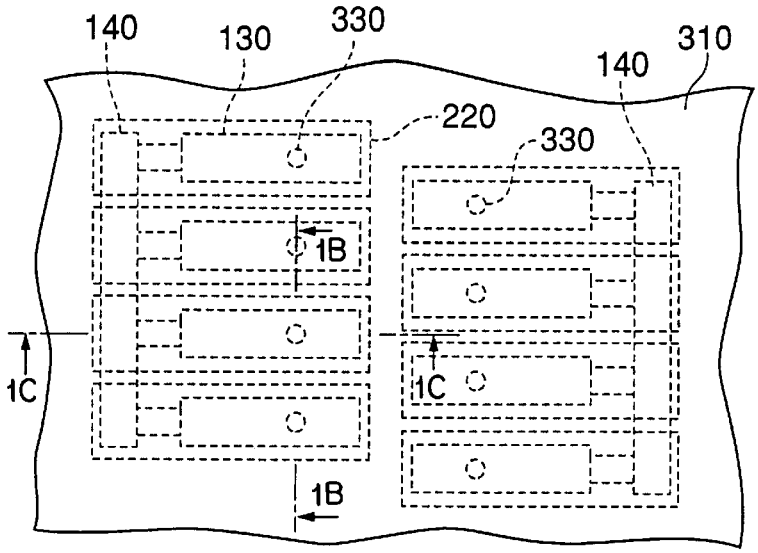
FIG. 1A, FIG. 1B FIG. 1C are views of a first preferred embodiment of the ink jet head of present invention.
Figure 1B:
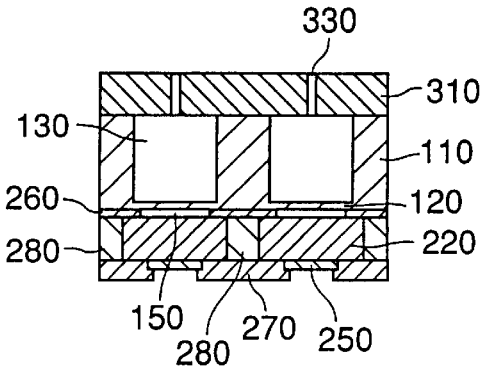
Figure 1C:
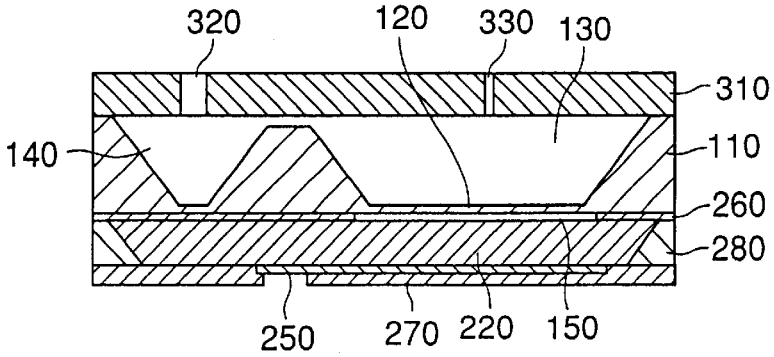

FIG. 1A through FIG. 1C illustrate a first preferred embodiment of the ink jet head of the present invention. FIG. 1A is a top view of the ink jet head of the present preferred embodiment, FIG. 1B is a cross-sectional view of this ink jet head taken along the line B—B in FIG. 1A, and FIG. 1C is a cross-sectional view of this ink jet head taken along the line C—C in FIG. 1A.

As shown in FIG. 1A through FIG. 1C, the ink jet head of the present preferred embodiment includes an ink-chamber substrate 110 which is preferably made of a single-crystal silicon (Si) wafer. The ink-chamber substrate 110 has an oscillation plate 120 which is preferably constructed to be integral with the ink-chamber substrate 110. In the ink-chamber substrate 110, individual pressure chambers 130 and a common chamber 140 include slanted surfaces arranged to have a <110> or <100> orientation of the single crystals of the silicon wafer. The slanted surfaces are formed by an anisotropic etching or grooving of the silicon wafer so that the slanted surfaces substantially correspond to the shapes of the pressure chambers 130 and the common chamber 140. In the present preferred embodiment, the oscillation plate 120 preferably has a thickness ranging from about 1 $\mu$m to about 10 $\mu$m.

The ink jet head of the present preferred embodiment includes a plurality of individual counter electrodes 220, each of which faces the oscillation plate 120 via an internal space or gap 150 between the ink-chamber substrate 110 and the counter electrode 220. The counter electrodes 220 are preferably formed from a single-crystal silicon (Si) wafer and each counter electrode 220 preferably has a thickness ranging from about 10 $\mu$m to about 100 $\mu$m. Each counter electrode 220 preferably has a surface arranged to have the <100> or <110> orientation of the single crystals of the silicon wafer, which is the surface facing the oscillation plate 120 via the internal space 150. A dielectric layer 260 preferably made of thermal-oxidation silicon dioxide ($SiO_2$) is provided between the ink-chamber substrate 110 and the counter electrodes 220 such that each counter electrode 220 is spaced from the oscillation plate 120 by the gap 150.

As shown in FIG. 1A, the ink jet head of the present preferred embodiment is divided into a plurality of small blocks, each of which contains a nozzle hole 330, the individual pressure chamber 130 and the individual counter electrode 220. A dielectric layer 280 preferably made of silicon dioxide ($SiO_2$) is interposed between the individual counter electrodes 220 of the adjacent blocks. The dielectric layer 280 electrically isolates each counter electrode 220 from the other counter electrodes 220. As shown in FIG. 1B and FIG. 1C, pad metal pieces 250 are provided on the bottom surfaces of the individual counter electrodes 220 which are opposite to the ink-chamber substrate 110. A passivation film 270 is provided on the counter electrodes 220 and the dielectric layer 280 and on the pad metal pieces 250. In the passivation film 270, a plurality of openings are formed such that only a portion of each pad metal piece 250 is exposed at the opening. A driving voltage, which actuates the oscillation plate 120 so as to impart a force and stress to the ink within the pressure chamber 130, is supplied from the exposed portion of each pad metal piece 250 to the individual counter electrode 220.

The ink jet head of the present preferred embodiment having the above-described configuration is formed preferably by bonding of the ink-chamber substrate 110 and the counter electrodes 220 through the dielectric layer 260 and by bonding of a nozzle plate 310 and the ink-chamber substrate 110. The nozzle plate 310 includes an ink supply hole 320 and a plurality of nozzle holes 330. The ink supply hole 320 communicates with the common chamber 140, and each of the nozzle holes 330 communicates with the individual pressure chamber 130.

In the ink jet head of the above-described preferred embodiment, when a driving voltage between the individual counter electrode 220 and the oscillation plate 120 is supplied, an electrostatic force is created so as to downwardly pull the oscillation plate 120 toward the individual counter electrode 220 via the internal space 150. At this instant, the internal pressure of the ink within the pressure chamber 130 is reduced, and the ink sent from the ink supply hole 320 is supplied from the common chamber 140 into the pressure chamber 130. When the driving voltage supply is turned off, the oscillation plate 120 is upwardly deflected so as to impart a force and stress to the ink within the pressure chamber 130, and the ink is discharged from the nozzle hole 330 onto a recording sheet.

In the present preferred embodiment, the oscillation plate 120 preferably has a thickness of about 5 $\mu$m that is much smaller than the thickness of about 50 $\mu$m of the counter electrode 220. The amount of deflection of each of the oscillation plate 120 and the counter electrode 220 when the driving voltage supply is turned on and off is in inversely proportional to the third power of the thickness thereof. The ink jet head of the present preferred embodiment maintains an adequately large amount of deflection of the oscillation plate 120, and it is effective in providing an increased efficiency of the ink discharge.

Figure 2A:
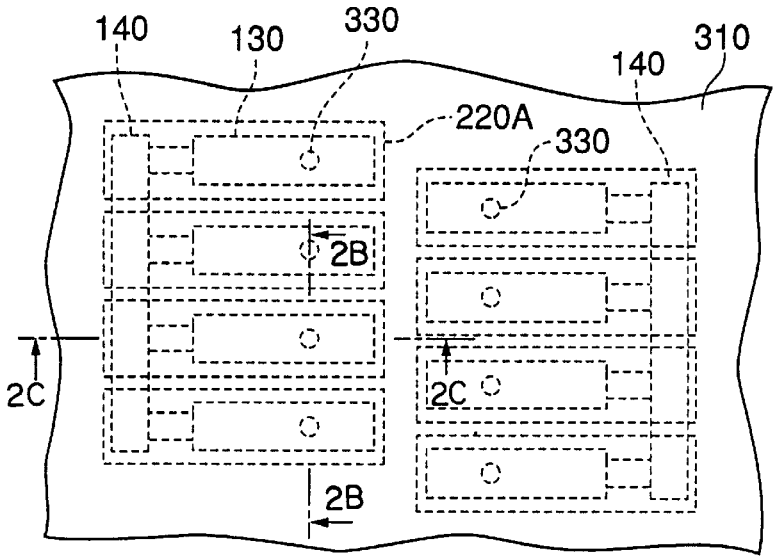
FIG. 2A, FIG. 2B and FIG. 2C are views of a second preferred embodiment of the ink jet head of the present invention.
Figure 2B:
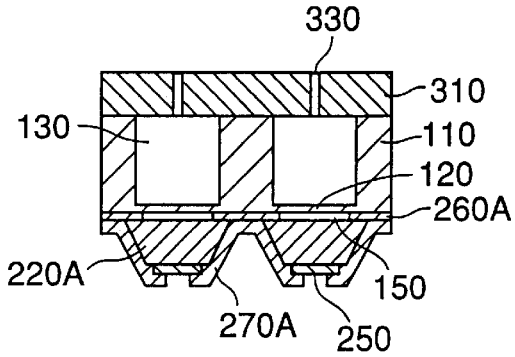
Figure 2C:
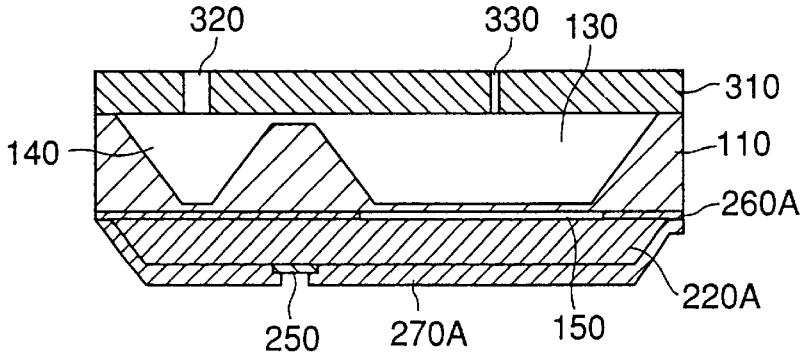

FIG. 2A through FIG. 2C show a second preferred embodiment of the ink jet head of the present invention. FIG. 2A is a top view of the ink jet head of the present preferred embodiment, FIG. 2B is a cross-sectional view of this ink jet head taken along the line B—B indicated in FIG. 2A, and FIG. 2C is a cross-sectional view of this ink jet head taken along the line C—C indicated in FIG. 2A.

In FIG. 2A through FIG. 2C, the elements which are essentially the same as corresponding elements in FIG. 1A through FIG. 1C are designated by the same reference numerals.

As shown in FIG. 2A through FIG. 2C, the ink jet head of the present preferred embodiment includes an ink-chamber substrate 110 which is preferably made of a single-crystal silicon wafer. The ink-chamber substrate 110 has an oscillation plate 120 which defines a unitary member and is integral with the ink-chamber substrate 110. In the ink-chamber substrate 110, individual pressure chambers 130 and a common chamber 140 are defined by slanted surfaces of the silicon wafer in the <110> or <100> orientation of the single crystals of the silicon wafer. The slanted surfaces are formed by grooving of the silicon wafer so that the slanted surfaces are in conformity with the shapes of the pressure chambers 130 and the common chamber 140. In the present preferred embodiment, the oscillation plate 120 preferably has a thickness of about 5 $\mu$m.

The ink jet head of the present preferred embodiment includes a plurality of individual counter electrodes 220A, each of which faces the oscillation plate 120 via an internal space or gap 150 between the ink-chamber substrate 110 and the counter electrode 220A. The counter electrodes 220A in the present preferred embodiment are preferably made of nickel (Ni) and each counter electrode 220A preferably has a thickness of about 50 $\mu$m. A dielectric layer 260A preferably made of a photosensitive polyimide resin is provided between the ink-chamber substrate 110 and the counter electrodes 220A such that each counter electrode 220A is spaced from the oscillation plate 120 by the internal space 150. The internal space 150 is formed by a pattern transferring to the dielectric layer 260A.

As shown in FIG. 2A, the ink jet head of the present preferred embodiment is divided into a plurality of small blocks each including a nozzle hole 330, the individual pressure chamber 130 and the individual counter electrode 220A. A passivation film 270A of a photosensitive polyimide resin is provided between the individual counter electrodes 220A of the adjacent blocks.

As shown in FIG. 2B and FIG. 2C, pad metal pieces 250 preferably made of aluminum (Al) are provided on the bottom surfaces of the individual counter electrodes 220A which are opposite to the ink-chamber substrate 110. The passivation film 270A is provided on the counter electrodes 220A and the dielectric layer 260A and on the pad metal pieces 250. In the passivation film 270A, a plurality of openings are formed such that only a portion of each pad metal piece 250 is exposed at the opening of the passivation film 270A. A driving voltage which actuates the oscillation plate 120 so as to impart a force and stress to the ink within the pressure chamber 130 is supplied from the exposed part of each pad metal piece 250 to the individual counter electrode 220A.

The ink jet head of the present preferred embodiment having the unique configuration described above is formed preferably by thermal pressure bonding of the ink-chamber substrate 110 and the counter electrodes 220A through the dielectric layer 260A and by bonding of a nozzle plate 310 and the ink-chamber substrate 110. The nozzle plate 310 includes an ink supply hole 320 and a plurality of nozzle holes 330. The ink supply hole 320 communicates with the common chamber 140, and each of the nozzle holes 330 communicates with the individual pressure chamber 130.

The ink jet head of the above-described preferred embodiment operates in the same manner as the previous preferred embodiment of FIG. 1A through FIG. 1C, when the driving voltage supply to the individual counter electrode 220 is turned on and off.

Figure 3A:
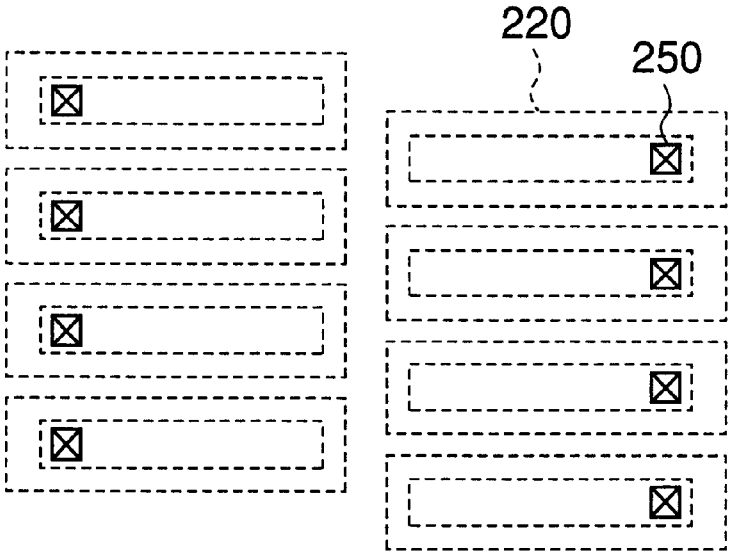
FIG. 3A and FIG. 3B are diagrams showing an arrangement of pad metal pieces of the ink jet head according to a preferred embodiment of the present invention.

FIG. 3A is a bottom view of the ink jet head of a preferred embodiment of the present invention for showing an arrangement of the pad metal pieces 250 in the ink jet head. In the arrangement of FIG. 3A, the pad metal pieces 250 are provided on the bottom surfaces of the individual counter electrodes 220. In the arrangement of FIG. 3A, the exposed parts of the pad metal pieces 250, from which the driving voltage is supplied to the counter electrodes 220, are arranged at positions under the counter electrodes 220 of the respective blocks.

Figure 3B:
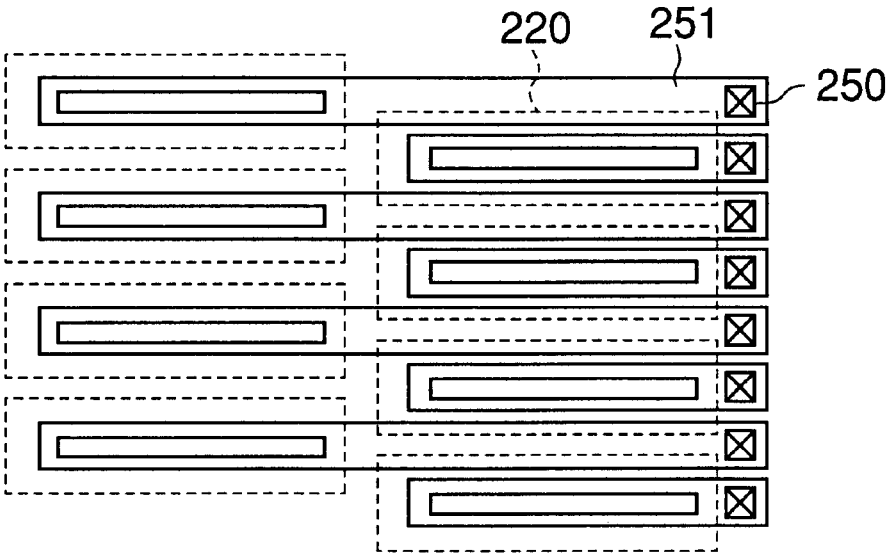

FIG. 3B shows another arrangement of the pad metal pieces 250 of the ink jet head according to another preferred embodiment of the present invention. In the arrangement of FIG. 3B, a dielectric layer is provided on the bottom surfaces of the individual counter electrodes 220. In the dielectric layer, a plurality of via holes or conductive through holes are formed at the locations under the counter electrodes 220. An end of each via hole on the internal surface of the dielectric layer is electrically connected to the counter electrode 220, and the other end of the via hole lies on the external surface of the dielectric layer. A plurality of lead metal pieces 251 are provided on the dielectric layer such that they extend from the via holes to the pad metal pieces 250. The electric connection between the counter electrode 220 and the pad metal piece of each block is established using the via hole and the lead metal piece 251. In the arrangement of FIG. 3B, the exposed portions of the pad metal pieces 250 are arranged at end positions of the respective blocks which are spaced from the positions under the counter electrodes 220.

FIG. 4A, FIG. 4B, FIG. 4C, FIG. 4D, FIG. 4E, FIG. 4F and FIG. 4G are diagrams for explaining a method of manufacturing the ink jet head of FIG. 1A through FIG. 1C. Steps of the manufacturing process for the ink jet head of the present preferred embodiment are sequentially performed in the order of FIGS. 4A–4G.

Figure 4A:
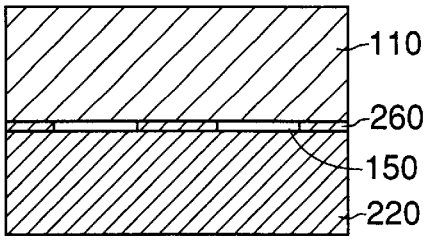
FIG. 4A, FIG. 4B, FIG. 4C, FIG. 4D, FIG. 4E, FIG. 4F and FIG. 4G are diagrams for explaining a process for producing the ink jet head of FIG. 1A through FIG. 1C.

In the step shown in FIG. 4A, a counter-electrode substrate 220 preferably made of a single-crystal silicon wafer is provided. The counter-electrode substrate 220 has a top surface arranged to have the <110> orientation of the single crystals of the silicon wafer. A dielectric layer 260 of thermal-oxidation silicon dioxide ($SiO_2$) having a thickness of about 5000 Å is made to grow on the top surface of the substrate 220. A pattern is transferred to the dielectric layer 260 by using a photolithography and etching technique, so that the gaps 150 are formed in the dielectric layer 260.

Next, as shown in FIG. 4A, an ink-chamber substrate 110 of a single-crystal silicon wafer is provided. The ink-chamber substrate 110 has a bottom surface in the <110> orientation of the single crystals of the silicon wafer. The ink-chamber substrate 110 is bonded to the counter-electrode substrate 220 via the dielectric layer 260 such that the <110> oriented surfaces of both substrates face each other. The gaps 150, which are intermittently formed by the pattern transferring to the dielectric layer 260, are provided between the ink-chamber substrate 110 and the counter-electrode substrate 220 as shown in FIG. 4A.

In the above step of FIG. 4A, the ink-chamber substrate 110 and the counter-electrode substrate 220 having the surfaces arranged to have the <110> orientation of the single crystals of the silicon wafer are used. Alternatively, the ink-chamber substrate 110 and the counter-electrode substrate 220 having the surfaces arranged to have the <100> orientation of the single crystals of the silicon wafer may be used instead. Further, an ink-chamber substrate 110 of a material other than the single-crystal silicon used in the above step, may be used instead.

In the step shown in FIG. 4A, the dielectric layer 260 is preferably formed on the counter-electrode substrate 220 only. Alternatively, the dielectric layer 260 may be formed on the ink-chamber substrate 110 only, or it may be formed on both the ink-chamber substrate 110 and the counter-electrode substrate 220. Further, a dielectric film preferably made of silicon dioxide may be additionally formed on the surfaces of the ink-chamber substrate 110 and the counter-electrode substrate 220, which are the surfaces facing each other via the internal space 150. In such a case, it is necessary to suitably adjust the depth of the internal space 150 by taking account of the thickness of such dielectric films.

Figure 4B:
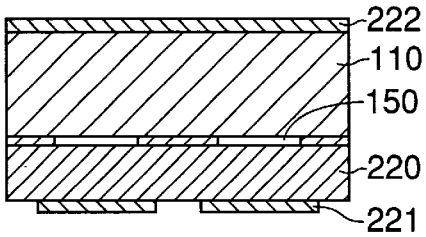

In a step shown in FIG. 4B, the counter-electrode substrate 220 of the intermediate module of FIG. 4A (in which the substrates 110 and 220 are bonded together) is ground so that an initial thickness of the counter-electrode substrate 220 is reduced to about 50 m. A layer 221 of silicon nitride and/or silicon oxide which functions as the mask for a subsequent step is prepared on the bottom surface of the counter-electrode substrate 220,and a layer 222 of silicon nitride and/or silicon oxide which functions as the mask for a subsequent step is prepared on the top surface of the ink-chamber substrate 110. By using the photolithography and etching technique, a pattern which is suited for the pattern of the gaps 150 in the dielectric layer 260 is transferred to the layer 221 and the mask 221 in the pattern is created.

In the step shown in FIG. 4B, the grinding of the counter-electrode substrate 220 is performed in order to form the counter electrodes 220 with accurate dimensions. If the requirement for pattern dimensions is permitted, the grinding may be omitted without changing the initial thickness of the counter-electrode substrate 220. In the above step, the layer 221 of silicon nitride and/or silicon oxide is used as the mask, but a layer of another suitable material may be used instead.

Figure 4C:
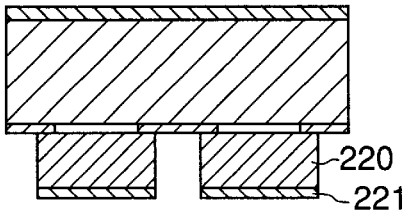

In a production step shown in FIG. 4C, etching of the counter-electrode substrate 220 is performed by using the mask 221 prepared in the step shown in FIG. 4B, so that the separate counter electrodes 220 are formed for the respective blocks of an intermediate module of the ink jet head. In order to form the counter electrodes 220 with accurate dimensions, a wet anisotropic etching using a solution of TMAH (tetramethyl-ammonium-hydroxide) is preferred. In the present preferred embodiment, the resulting counter electrodes 220 include side surfaces arranged to have the <111> orientation of the single crystals of the silicon wafer. The side surfaces contact the dielectric layer 280 which will be described below with respect to FIG. 4D. Alternatively, wet anisotropic etching using a solution of KOH (potassium hydroxide) may be used.

In the step shown in FIG. 4C, a wet anisotropic etching of the counter-electrode substrate 220 is performed. Alternatively, a dry etching may be used instead. In such a case, a layer of silicon oxide, rather than silicon nitride, is more suitable for the mask for a subsequent step. Further, a resist mask may be used instead. If the requirement for pattern dimensions is permitted, the use of isotropic etching is possible.

Figure 4D:
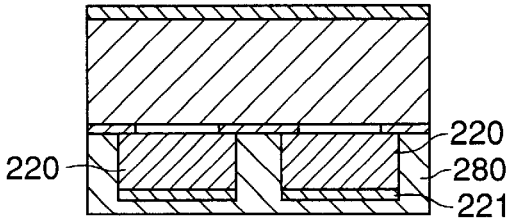

In the step shown in FIG. 4D, by performing spin coating and baking, the dielectric layer 280 of silicon dioxide is arranged on the entire bottom surface of the intermediate module of FIG. 4C (in which the separate counter electrodes 220 are formed for the respective blocks of the ink jet head). As shown in FIG. 4D, the dielectric layer 280 is interposed between the individual counter electrodes 220 of the adjacent blocks. As described above, the side surfaces of each counter electrode 220 contact the dielectric layer 280. Alternatively, a normal-pressure chemical vapor deposition (CVD) may be performed instead of the spin coating and baking technique. Further, a plasma CVD or thermal oxidation may be performed to form the dielectric layer 280 of silicon dioxide. Further, instead of the dielectric layer 280 of silicon dioxide, a dielectric layer of a photosensitive polyimide resin may be formed by performing the spin coating and baking.

Figure 4E:
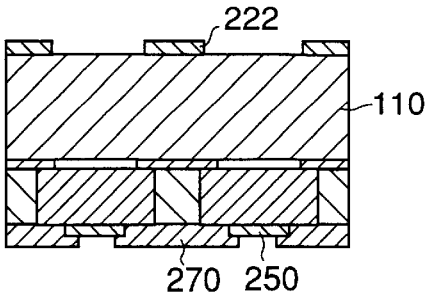

In the step shown in FIG. 4E, etching is performed on the intermediate module of FIG. 4D so that the dielectric layer 280 and the mask 221 are removed until the bottom surfaces of the counter electrodes 220 appear. After the etching is performed, a layer 250 of aluminum (Al) is deposited on the bottom surfaces of the counter electrodes 220 preferably via sputtering. After the sputtering is performed, by using the photolithography and etching technique, a pattern which is suitable for the pattern of the counter electrodes 220 is transferred to the layer 250, and the pad metal pieces 250 are formed on the bottom surfaces of the counter electrodes 220. Further, a passivation film 270 of silicon nitride and/or silicon oxide is deposited on the entire bottom surface of the intermediate module using a plasma CVD technique, and a plurality of openings are formed in the passivation film 270 such that only a portion of each pad metal piece 250 is exposed at the opening.

Further, in the step shown in FIG. 4E, by using the photolithography and etching technique, a pattern which is suitable for the pattern of the pressure chambers 130 and the common chamber 140 in the ink-chamber substrate 110 is transferred to the layer 222 on the top surface of the intermediate module (which layer is formed in the step shown in FIG. 4B), and the mask 222 in the pattern is created.

In the above step of FIG. 4E, the layer 250 of aluminum is used to form the pad metal pieces 250 but a layer of any one of gold (Au), platinum (Pt) or titanium (Ti) may be used instead. Further, in the above step shown in FIG. 4E, the passivation film 270 of silicon nitride and/or silicon oxide is formed but a passivation film of another suitable material may be formed.

Figure 4F:
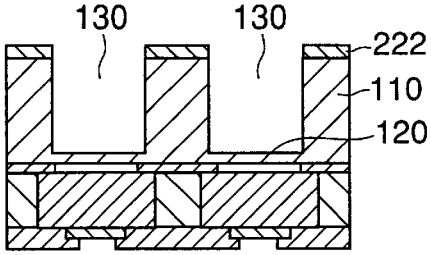

In the step shown in FIG. 4F, etching of the ink-chamber substrate 110 is performed by using the mask 222 prepared in the above step of FIG. 4E, so that the pressure chambers 130 and the common chamber 140 are formed in the ink-chamber substrate 110. At the same time, the oscillation plate 120 preferably having a thickness of about 5 $\mu$m is formed for each of the pressure chambers 130. In order to form the pressure chambers 130 and the common chamber 140 with accurate dimensions, a wet anisotropic etching using a solution of TMAH (tetra-methyl-ammonium-hydroxide) is preferred. Alternatively, a wet anisotropic etching using a solution of KOH (potassium hydroxide) may be used.

Figure 4G:
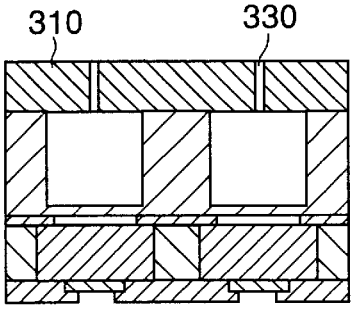
Figure 5A:
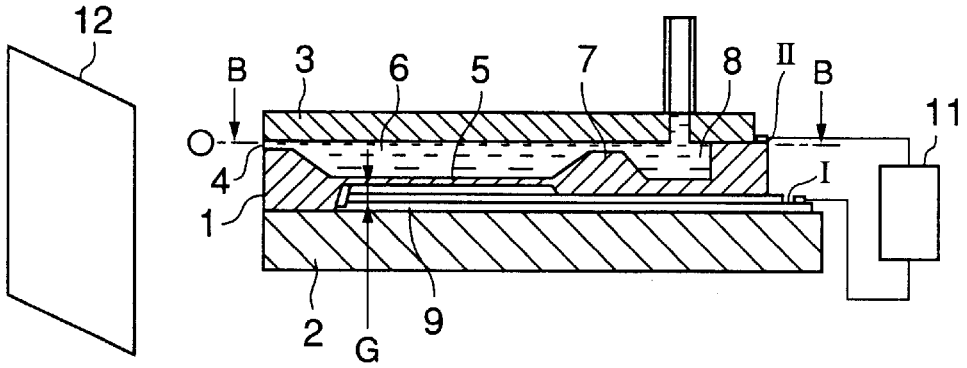
FIG.5A PRIOR ART
FIG. 5A and FIG. 5B are views of a conventional ink jet head.
Figure 5B:
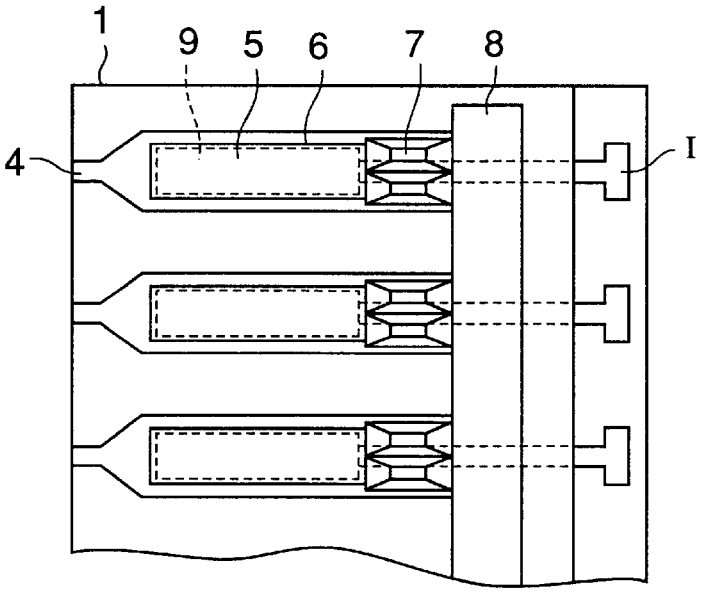
FIG.5B PRIOR ART
Figure 6:
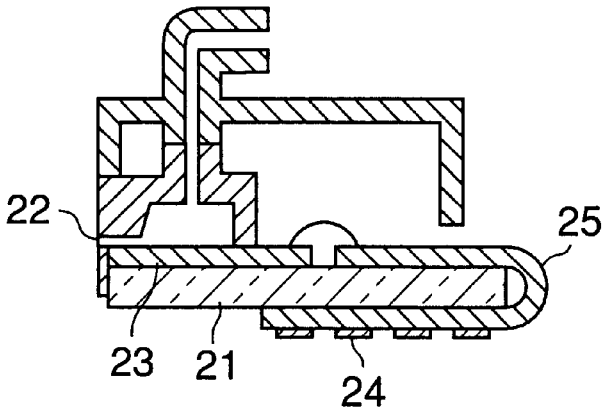
FIG.6 PRIOR ART
FIG. 6 is a cross-sectional view of another conventional ink jet head.
Figure 7:
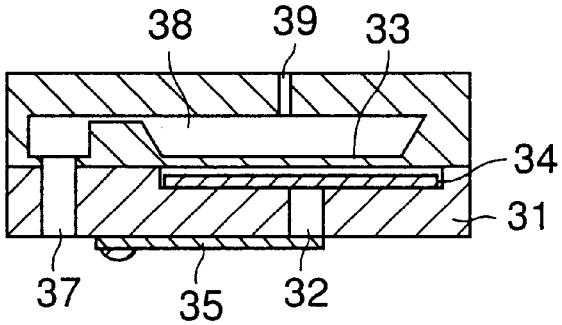
FIG.7 PRIOR ART
FIG. 7 is a cross-sectional view of another conventional ink jet head.

In the step shown in FIG. 4G, the mask 222 is removed from the intermediate module of FIG. 4F, and a nozzle plate 310, including an ink supply hole 320 and a plurality of nozzle holes 330, is attached to the top surface of the ink-chamber substrate 110. The position of the nozzle plate 310 relative to the ink-chamber substrate 110 is adjusted so that the nozzle holes 330 match the respective positions of the pressure chambers 130. A bonding of the nozzle plate 310 and the ink-chamber substrate 110 is performed by using an epoxy-base adhesive agent. As shown in FIG. 4G, the ink jet head of the present preferred embodiment is finally produced through the above-described production process.

The present invention is not limited to the above-described preferred embodiments, and variations and modifications may be made without departing from the scope of the present invention.

Further, the present invention is based on Japanese priority application No. 10-350,609, filed on Dec. 10, 1998, the entire contents of which are hereby incorporated by reference.

What is claimed is:

1. An ink jet head comprising:

a nozzle plate having a nozzle hole; an ink chamber substrate provided on a back of the nozzle plate, the ink chamber substrate including an integral unitary member having an oscillation plate and a pressure chamber, the pressure chamber containing ink and communicating with the nozzle hole, and the oscillation plate defining a bottom of the pressure chamber;

a counter electrode substrate having an electrically isolated counter electrode, the counter electrode facing the oscillation plate via a gap between the oscillation plate and the counter electrode;

a dielectric layer interposed between the ink chamber substrate and the counter electrode substrate, the dielectric layer formed in a pattern that separates the counter electrode substrate and the ink chamber substrate, thereby providing a space that defines the gap between the oscillation plate and the counter electrode; and a pad metal piece in direct electrical contact with a surface of the counter electrode, the pad metal piece being arranged such that a driving voltage externally applied from the pad metal piece to the counter electrode actuates the oscillation plate to impart a stress on the ink within the pressure chamber.

2. The ink jet head according to claim 1, wherein the ink chamber substrate and the counter electrode are made of a single-crystal silicon.

3. The ink jet head according to claim 2, wherein the counter electrode has side surfaces arranged to have a <111> orientation of single crystals of the silicon, and the side surfaces contact the first dielectric layer.

4. The ink jet head according to claim 2, wherein the counter electrode has a top surface arranged to have a <110> orientation of single crystals of the silicon, and the top surface faces the oscillation plate via the gap.

5. The ink jet head according to claim 2, wherein the counter electrode has a top surface arranged to have a <100> orientation of single crystals of the silicon, and the top surface faces the oscillation plate via the gap.

6. The ink jet head according to claim 1, wherein the counter electrode substrate includes a second dielectric layer contained therein to electrically isolate the counter electrode.

7. The ink jet head according to claim 1, wherein the oscillation plate is made of a single-crystal silicon and has a surface arranged to have a <110> orientation of single crystals of the silicon, the surface facing the counter electrode via the gap.

8. The ink jet head according to claim 1, wherein the oscillation plate is made of a single-crystal silicon and has a surface arranged to have a <100> orientation of single crystals of the silicon, the surface facing the counter electrode via the gap.

9. The ink jet head according to claim 1, wherein the ink chamber substrate is of made a single-crystal silicon and the counter electrode is made of a metallic material.

10. The ink jet head according to claim 9, wherein the dielectric layer between the ink chamber substrate and the counter electrode substrate is made of a resin material.

11. The ink jet head according to claim 9, further comprising a passivation film, wherein the counter electrode is electrically isolated by the passivation film including a resin material.

12. The ink jet head according to claim 1, wherein the oscillation plate has a thickness ranging from about 1 $\mu$m to about 10 $\mu$m.

13. The ink jet head according to claim 1, wherein the counter electrode has a thickness ranging from about 1 $\mu$m to about 10 $\mu$m.

14. The ink jet head according to claim 1, wherein the dielectric layer is made of silicon dioxide.

15. The ink jet head according to claim 1, further comprising a plurality of counter electrodes, wherein the dielectric layer is arranged to electrically isolate each of the counter electrodes from each other.

16. The ink jet head according to claim 1, further comprising a passivation film provided on the counter electrode and the dielectric layer and on the pad metal piece.

17. The ink jet head according to claim 1, wherein the pad metal piece is made of aluminum.

18. An ink jet head comprising:

a nozzle plate having a nozzle hole;

an ink chamber substrate provided on the nozzle plate, the ink chamber substrate including an integral unitary member having an oscillation plate and a pressure chamber, the pressure chamber containing ink and communicating with the nozzle hole, and the oscillation plate defining a bottom of the pressure chamber;

a counter electrode substrate having an electrically isolated counter electrode, the counter electrode facing the oscillation plate via a gap between the oscillation plate and the counter electrode, a dielectric layer interposed between the ink chamber substrate and the counter electrode substrate, the dielectric layer formed in a pattern that separates the counter electrode substrate and the ink chamber substrate, thereby providing a space that defines the gap between the oscillation plate and the counter electrode.

19. The ink jet head according to claim 18, further comprising a pad metal piece provided on the counter electrode and electrically connected to the counter electrode.

20. The ink jet head according to claim 18, wherein the dielectric layer is made of one of silicone dioxide and a resin material.

* * * * *